169-45 SR
5/9/78 OR 4,088,193

United States Patent [19]

Colgate

[11] 4,088,193

[45] May 9, 1978

[54] APPARATUS FOR INHIBITING EXPLOSIVE MIXING OF LIQUID NATURAL GAS AND WATER

[76] Inventor: Stirling A. Colgate, General Delivery, Ward, Colo. 80481

[21] Appl. No.: 654,518

[22] Filed: Feb. 2, 1976

[51] Int. Cl.[2] ..... A62C 13/40

[52] U.S. Cl. ..... 169/45; 62/55; 114/74 A; 169/62; 169/68; 220/88 B

[58] Field of Search ..... 169/62, 11, 12, 66, 169/68, 45; 220/88 R, 88 B; 114/74 A, 187, 270; 62/55

[56] References Cited

U.S. PATENT DOCUMENTS

| | | | |
|---|---|---|---|
| 2,889,955 | 6/1959 | Naulty et al. | 220/88 B |
| 3,319,431 | 5/1967 | Clarke et al. | 62/55 X |
| 3,349,572 | 10/1967 | Niemann | 62/55 |
| 3,374,638 | 3/1968 | Basile et al. | 62/55 X |
| 3,389,829 | 6/1968 | Stanford | 220/88 B X |
| 3,804,292 | 4/1974 | Chiti | 220/88 B |
| 3,930,541 | 1/1976 | Bowman et al. | 169/66 X |

*Primary Examiner*—Joseph F. Peters, Jr.
*Assistant Examiner*—Michael Mar
*Attorney, Agent, or Firm*—Brumbaugh, Graves, Donohue & Raymond

[57] ABSTRACT

Fluid-fluid explosive self-mixing of water and liquid natural gas contained in a cryogenic tank located in a hold of a ship is inhibited, in the event that the hold of the ship and the cryogenic tank are ruptured, by confining an inert gas under pressure in a multiplicity of tubes surrounding the cryogenic tank, the pressure of the inert gas in the tubes being such that the inert gas flows from the tubes to form a blanket of inert gas between liquid natural gas and water upon rupture of any tube or tubes.

6 Claims, 1 Drawing Figure

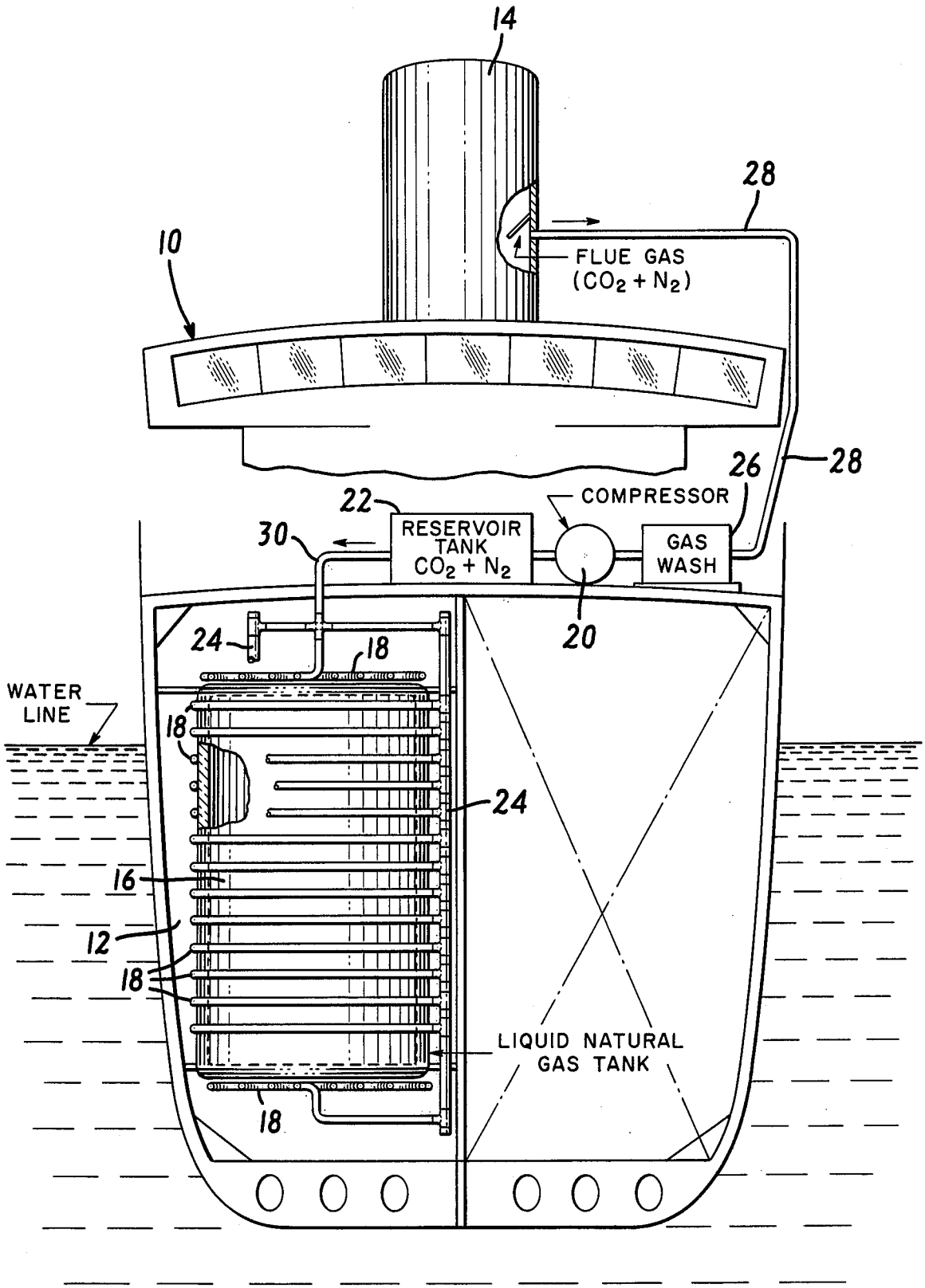
14
28
10
FLUE GAS
($CO_2 + N_2$)
26
28
22
COMPRESSOR
30
RESERVOIR
TANK
$CO_2 + N_2$
GAS
WASH
20
24
18
WATER
LINE
18
24
16
12
18
LIQUID NATURAL
GAS TANK
18

APPARATUS FOR INHIBITING EXPLOSIVE MIXING OF LIQUID NATURAL GAS AND WATER

BACKGROUND OF THE INVENTION

Fluid-fluid explosive self-mixing, sometimes referred to as "steam" explosions in the particular circumstances where water is involved, is a common and well known hazard and phenomenon in industry, particularly the foundry industry. Such an explosion can occur, for example, when a hot molten metal falls into a bath of water or on damp earth. The violence of these explosions can be major. In the aluminum industry there have been accidents where more than 100 workmen have been killed and a whole foundry destroyed.

Such explosions are caused primarily by bringing a hot fluid — e.g., hot molten metal, salt, or glass — into sudden and close contact with a cold vaporizable fluid — e.g., water, industrial solvents, or heat transfer fluids — that have a high vapor pressure, say on the order of hundreds of atmospheres, when they are at the temperature of the hot fluid. Under these circumstances, an explosion frequently occurs if some kind of trigger pressure pluse forces the fluids into contact with one another. However, the explosion may not need to be triggered in all cases. In other instances, minor triggers — e.g., delayed supercritical boiling, mechanical motion, and even bubbles of one fluid trapped by the other in the bottom of a container — may cause the explosion. At any rate, once a rapid mixing begins, it is likely to continue until a fair fraction of the two fluids have exchanged almost all their heat and energy. Apparently, the mixing is self-driven, and fluid instabilities allow one fluid to mix into the other in extremely small particles, as small as a micron in size, so that the heat exchange occurs in milliseconds or less time. The pressure of the explosion is limited by the vapor or "steam" pressure at the temperature of the hot fluid. This may be 5,000 to 10,000 psi for molten metals and water.

A similar fluid-fluid self-mixing explosion can occur between a cold fluid like cryogenic gases and a hot fluid like water or any other room temperature fluid — e.g., oil, gasoline, or alcohol. The driving pressure is the gas pressure of the cryogenic gas at liquid density and room temperature. When the temperature difference between the cryogenic gas and the room temperature fluid is not as large as, say, molten steel and water, the explosions will not be so violent and may require a larger trigger in order to be initiated.

A cryogenic fluid-fluid self-mixing explosion is greatly feared in the situation where a tanker ship carrying liquid natural gas — i.e., liquid methane — is involved in a collision or other accident. The water is the hot fluid, and liquid natural gas is the cryogenic cold fluid. In this situation even a very modest explosion could rip the ship apart, releasing the entire cargo of gas, which could then deflagrate with far worse consequences than the original fluid-fluid self-mixing explosion itself. For example, if a 100,000 ton tanker carrying liquid methane were to collide with another ship in circumstances causing a fluid-fluid self-mixing explosion, the explosion could conceivably be as large as the available energy difference between the liquid methane and the water — i.e., equivalent roughly to 10,000 tons of a normal high-explosive. This, or a smaller explosion, could disperse the methane into the atmosphere. If the methane were then ignited when it reached the correct stoichiometric mixture with the oxygen in the atmosphere, the deflagration or detonation could be equivalent roughly to 1,000,000 tons of a normal high-explosive. There is obviously, therefore, considerable motivation to reduce the probability of such an event occurring within the harbor of a large city.

Many individuals have studied the possible explosive self-mixing of liquid natural gas and water and come to varying conclusions concerning its safety. These revolve around questions of supercritical boiling, the admixture of ethane, etc., but the fact remains that some fluid-fluid self-mixing explosions involving liquid natural gas have been created in the laboratory and in the field; the U.S. Coast Guard, for example, has conducted such experiments.

The one requirement for a fluid-fluid self-mixing explosion is that the fluids must come into intimate contact. If a gas film or gas barrier is interposed, the fluids will not explosively self-mix because the gas film pressure is too low. If a gas film is formed by the two fluids themselves — e.g., if they are poured relatively slowly into each other — it is conceivable that they will only boil and not explode. In this situation, the gas film must be formed at a rate greater than the rate at which the two fluids come into contact. Therefore, if something inhibits the formation of such a gas film — like the property of the cold fluid to transiently come to the temperature of the hot fluid without boiling, the property called "superheat" — the two fluids could come into contact without a gas film so that they might explosively self-mix. This is the property that has been proposed by Fauske to explain fluid-fluid explosive self-mixing.

On the other hand if regardless of the superheat criteria a pressure pluse strong enough to overcome the gas film is applied, the fluids will explosively self-mix. This has been shown for very hot molten metals and water. Thus, in the situation where a tanker ship is carrying liquid natural gas, there is a real danger of a fluid-fluid self-mixing explosion between the gas and the water because of the large amount of gas and the possible triggering effect of high pressures created during a collision.

SUMMARY OF THE INVENTION

There is provided, in accordance with the present invention, a method and apparatus employing the method that significantly increase the safety in transporting liquid natural gas in ships. In particular, each cryogenic tank on a ship is surrounded by a multiplicity of closely spaced tubes, and an inert gas is confined under pressure in the tubes, the pressure of the inert gas in the tubes being such that the inert gas flows from the tubes and forms a blanket of inert gas between liquid natural gas and water upon rupture of any tube or tubes.

The tubes are positioned close to the walls of the tank, and therefore any incident that causes the tank to rupture will almost certainly also cause at least one and most probably many of the tubes also to rupture. The inert gas flows from the tubes and inhibits forced contact between the liquid natural gas and any water that may be present around the tank. If the inert gas continues to flow, the amount of water contacting the liquid natural gas will be maintained at a safe level. Conceivably, if a large enough reservoir of inert gas is provided and the tank remains partially intact, venting and transfer can be accomplished using the blanket of inert gas to inhibit mixing of the liquid natural gas and water. The greatest hazard is a collision with another ship, and any collision that results in rupture of a liquid natural gas tank will almost certainly include a rupture of the hull of the liquid natural gas ship, thereby introducing water into proximity to the tank.

In liquid natural gas ships, flue gas ($CO_2 + N_2$) from the ship's boilers is an excellent source of inert gas for circulation through the protective tubes. As long as the boilers are fired there is a virtually constant and unlimited supply of flue gas available. The gas is conducted through suitable gas cleaning devices to remove impurities, is compressed and is supplied to the tube system, preferably via a reservoir tank.

BRIEF DESCRIPTION OF THE DRAWING

For a better understanding of the invention, reference may be made to the following description of an exemplary embodiment, taken in conjunction with the single figure of the accompanying drawing which illustrates diagrammatically a mode of carrying out the invention.

DESCRIPTION OF AN EXEMPLARY EMBODIMENT

Referring to the drawing, there is shown a ship 10 including a hold 12 and a smokestack 14 for discharging flue gas — i.e., $CO_2 + N_2$ — from the boilers of the ship 10. The hold 12 houses a cryogenic tank 16 which contains liquid natural gas. A multiplicity of tubes 18 surrounds the tank 16 externally of its thermal insulation.

A compressor 20 is connected to the smokestack 14 by an intake pipe 28 which includes a gas wash 26 located on the inlet end of the compressor 20. A supply conduit 30 which branches off into a plurality of headers 24 connects the compressor 20 to the tubes 18. A reservoir tank 22 is positioned in the supply conduit 30 between the compressor 20 and the headers 24.

The compressor 20 pumps flue gas under pressure from the smokestack 14 to the reservoir tank 22, the gas wash 26 removing impurities from the flue gas before it reaches the compressor 20. From the reservoir tank 22, the flue gas is pumped under pressure to the tubes 18 through the headers 24. Thus, the flue gas is confined under pressure in the reservoir tank 22, the header 24 and the tubes 18, the pressure of the inert gas in the tubes 18, the headers 24 and the reservoir tank 22 being such that the inert gas flows from the tubes 18 and forms a blanket of inert gas between the liquid natural gas and any water in proximity to the tank 16, in the event that the tank 16 ruptures, upon rupture of any tube or tubes. Inasmuch as the tubes 18 are located outside the thermal insulation of the tank 16, liquefication of the flue gas by the low temperature of the liquid natural gas is prevented.

The tubes 18 are filled with flue gas at a pressure high enough — e.g., 100 to 200 psi — so that the flue gas will flow out easily from ruptured ends of the tubes 18 against the water pressure corresponding to the deepest tank — e.g., 20 to 30 psi — for deep draft tankers. The tubes 18, which may be of aluminum or any other suitable material, have a diameter of one-half inch on a spacing of 6 inches, approximately one-half the thickness of the standard thermal insulation for the cryogenic tank 16. The headers 24 are connected to the tubes 18 at intervals not greater than 500 tube diameters, or roughly 20 feet.

Depending upon the design parameters, the tubing size and spacing, flow pressure, and header spacing may require variation, but in any event the pressure of the inert gas blanket should be larger enough to inhibit the degree to which the seawater and liquid natural gas come into contact. Thus, even if a fluid-fluid self-mixing explosion is initiated, its propagation would be inhibited by the presence of a large fraction of gas bubbles which reduce the pressure of the explosion.

It will be understood that the above described embodiments are merely exemplary and that persons skilled in the art may make many variations and modifications without departing from the spirit and scope of the invention. For example, the inert gas may be stored in a container carried on the vessel, rather than being supplied by the smokestack. All such modifications and variations are intended to be included within the scope of the invention as defined in the appended claims.

I claim:

1. An apparatus for inhibiting fluid-fluid explosive self-mixing of cryogenic fluid contained in a cryogenic tank and water in proximity to the tank, in the event of rupture of the cryogenic tank, comprising a multiplicity of tubes surrounding the cryogenic tank, a source of an inert gas connected to the tubes, thermal insulation between the tubes and the tank to prevent liquefication of the inert gas contained in the tubes and means for confining and maintaining the inert gas under pressure in the tubes, the pressure of the inert gas in the tubes being substantially higher than the highest water pressure to which the cryogenic fluid may be subjected in the event of rupture of the tank such that the inert gas flows from the tubes and forms a blanket of inert gas between cryogenic fluid and water upon rupture of any tube or tubes.

2. An apparatus according to claim 1, wherein the inert gas is flue gas ($CO_2 + N_2$) and the source thereof is a combustion process.

3. An apparatus according to claim 1, wherein the pressure of the inert gas in the tubes is in the order of about 100 to about 200 psi.

4. An apparatus according to claim 1, wherein the cryogenic tank is located in or on a ship, the inert gas is flue gas ($CO_2 + N_2$) and the source thereof is a combustion process.

5. A method of inhibiting fluid-fluid explosive self-mixing of a cryogenic fluid contained in a cryogenic tank and water in proximity to the tank, in the event that the tank is ruptured, comprising the step of confining and maintaining an inert gas under pressure in a multiplicity of tubes located close to each other and surrounding the tank and thermally insulated from the tank to prevent liquefication of the inert gas contained in the tubes, the pressure of the inert gas in the tubes being substantially higher than the highest water pressure to which the cryogenic fluid may be subjected in the event of rupture of the tank such that the inert gas flows from the tubes and forms a blanket of inert gas that inhibits forced contact between the cryogenic fluid and the water upon rupture of any tube or tubes.

6. A method according to claim 5, wherein the inert gas is maintained at a pressure in the order of about 100 to about 200 psi.

* * * * *